US007503819B1

(12) United States Patent
Jaeger et al.

(10) Patent No.: US 7,503,819 B1
(45) Date of Patent: Mar. 17, 2009

(54) CLOSED COOLING SYSTEM FOR A MARINE ENGINE

(75) Inventors: Matthew W. Jaeger, Stillwater, OK (US); Derric Drake, Stillwater, OK (US); William C. Martin, Stillwater, OK (US)

(73) Assignee: Brunswick Corporation, Lake Forest, IL (US)

( * ) Notice: Subject to any disclaimer, the term of this patent is extended or adjusted under 35 U.S.C. 154(b) by 17 days.

(21) Appl. No.: 11/651,194

(22) Filed: Jan. 9, 2007

(51) Int. Cl.
*B63H 21/14* (2006.01)
*B60H 1/00* (2006.01)
*F01P 5/10* (2006.01)

(52) U.S. Cl. ..... 440/88 C; 165/41; 123/41.44

(58) Field of Classification Search ..... 440/88 C
See application file for complete search history.

(56) References Cited

U.S. PATENT DOCUMENTS 4,220,121 A 9/1980 Maggiorana ..... 123/41.8
4,759,181 A * 7/1988 Biritz ..... 60/321
4,991,546 A 2/1991 Yoshimura ..... 123/41.31
5,004,042 A 4/1991 McMorries et al. ..... 165/41
5,746,270 A 5/1998 Schroeder et al. ..... 165/41
6,368,169 B1 4/2002 Jaeger ..... 440/88
6,748,906 B1 6/2004 White et al. ..... 123/41.01
7,195,055 B1 * 3/2007 Jaeger ..... 165/51
7,217,168 B2 * 5/2007 Okamoto ..... 440/89 C

* cited by examiner

*Primary Examiner*—Jesus D Sotelo
(74) *Attorney, Agent, or Firm*—William D. Lanyi

(57) ABSTRACT

A cooling system for a marine propulsion device provides a closed portion of the cooling system which recirculates coolant through the engine block and cylinder head, the exhaust manifold, and the exhaust elbow. It provides a pressure relief cap connected to the exhaust elbow and a low velocity portion of the coolant jacket of the exhaust elbow to facilitate the release of gas and coolant when pressures exceed a preselected magnitude.

3 Claims, 7 Drawing Sheets

CLOSED COOLING SYSTEM FOR A MARINE ENGINE

BACKGROUND OF THE INVENTION

1. Field of the Invention

The present invention is generally related to a cooling system for a marine engine and, more particularly, to a closed cooling system in which coolant is recirculated through heat emitting portions of the marine engine and particularly through exhaust components such as an exhaust manifold and elbow.

2. Description of the Related Art

Those skilled in the art of marine engine cooling systems are familiar with many types of systems that circulate coolant in thermal communication with heat emitting components. Some cooling systems are open loop systems in which water is drawn from a body of water, passed through conduits in thermal communication with the heat emitting portions of the propulsion system, and then returned to the body of water. Some systems are closed cooling systems in which a coolant, such as an ethylene glycol mixture, is recirculated through conduits disposed in thermal communication with heat emitting components of the propulsion system. Typically water is drawn from a body of water in which the marine propulsion system is operated and the water is caused to flow in thermal communication with the coolant of the closed loop portion of the system. In these types of marine propulsion systems, some heat emitting components are cooled by the coolant within the closed loop portion of the system and other components are cooled by the water drawn from the body of water. The closed loop coolant is cooled by flowing in thermal communication with the water from the body of water as the two fluids flow through a heat exchanger.

U.S. Pat. No. 4,220,121 which issued to Maggiorana on Sep. 2, 1980, discloses a heat exchanger for marine propulsion engines. The heat exchanger is provided for a pressurized, closed cooling system for a marine propulsion engine. The heat exchanger includes a closed spiral passageway means for fresh cooling water drawn from the lake or other water body. An outer housing encloses the spiral passageway and includes baffle means for directing of a coolant in a spiral path over the cooling passageway means within the housing. The coolant is thereby cooled by the circulating cold freshwater. An air discharge passageway means is provided in the center of the spiral path. The centrifugal forces associated with the spiral flow of the cooling coolant results in the water moving outwardly within the passageway while the air tends to collect within the center thereof where it is collected and discharged by the air passageway means for automatic separation and removal of the air.

U.S. Pat. No. 4,991,546, which issued to Yoshimura on Feb. 12, 1991, describes a cooling device for a boat engine. A cooling jacket delivers its coolant to an exhaust manifold cooling jacket adjacent the inlet end of the exhaust manifold and coolant is delivered from the exhaust manifold cooling jacket to a further cooling jacket around the inlet portion of an exhaust elbow. In one embodiment, a closed cooling system is provided for the engine cooling jacket, exhaust manifold cooling jacket and the elbow cooling jacket. In another embodiment, the system discharges coolant back to the body of water in which the watercraft is operating through a further cooling jacket of the exhaust elbow that communicates with its discharge ends.

U.S. Pat. No. 5,004,042, which issued to McMorries et al. on Apr. 2, 1991, discloses a closed loop cooling system for a marine engine. The closed loop cooling system includes a marine engine having a cooling fluid passage defined therethrough through which a cooling fluid stream may pass. A shell and tube heat exchanger has a tube side flow path and a shell side flow path defined therein. Cooling fluid conduits connect the cooling fluid passage from the marine engine to the tube side flow path so that the cooling fluid stream from the engine is directed through the tube side flow path of the heat exchanger. A raw water supply system directs a raw water stream from a body of water through the shell side flow path and then back to the body of water. The heat exchanger includes an outer housing and a tube bundle receiver in the outer housing.

U.S. Pat. No. 5,746,270, which issued to Schroeder et al. on May 5, 1998, discloses a heat exchanger for a marine engine cooling system. The assembly is provided for a marine propulsion system having a closed loop cooling system. The heat exchanger body encloses a series of tubes carrying sea water which removes heat from the engine coolant. The heat exchanger includes an integrally connected top tank. A single venting orifice is provided into the top tank from the heat exchanger body. A heat exchanger coolant outlet is in direct fluid communication with both a system bypass and the coolant in the top tank. An auxiliary inlet for coolant from the top tank is located in the heat exchanger coolant outlet downstream of the bypass inlet, thereby promoting the ability of the system to draw coolant through the top tank rather than the bypass. The construction minimizes cavitation and reduces the creation of negative pressure at the circulating pump.

U.S. Pat. No. 6,368,169, which issued to Jaeger on Apr. 9, 2002, discloses a marine engine cooling system with siphon inhibiting device. A siphon inhibiting valve is provided for a marine engine cooling system. The purpose of the valve is to prevent the draining of the pump and outboard drive unit from creating a siphon effect that draws water from portions of the cooling system where heat producing components exist. The valve also allows intentional draining of the system when the vessel operator desires to accomplish this function. The valve incorporates a ball that is captivated within a cavity. If the ball is lighter than water, its buoyancy assists in the operation of the valve.

U.S. Pat. No. 6,748,906, which issued to White et al. on Jun. 15, 2004, discloses a heat exchanger assembly for a marine engine. It is disposed between first and second sides of a V-shaped engine configuration. A plurality of tubes and related structure are disposed within a cavity formed as an integral part of an air intake manifold of the engine. A first cooling fluid, such as ethylene glycol, is circulated in thermal communication with outer surfaces of the plurality of tubes within the heat exchanger and a second fluid such as lake or sea water is circulated through the internal passages of the plurality of tubes. A conduit is provided within an end portion of the heat exchanger to remove heat from a lubricant, such as oil, of the internal combustion engine.

The patents described above are hereby expressly incorporated by reference in the description of the present invention.

It would be significantly beneficial if a marine propulsion system could be provided with a cooling system that cools not only engine components, but exhaust components, with the coolant of the closed loop portion of the system. The components which are cooled by the closed loop coolant could then be manufactured from a low density metal, such as aluminum, that would otherwise be prohibited if they were exposed to water drawn from a body of water in which the marine propulsion system is operated.

SUMMARY OF THE INVENTION

A cooling system for a marine propulsion device, made in accordance with a preferred embodiment of the present invention, comprises a first cooling circuit configured to circulate a first coolant in thermal communication with a first group of components, a second cooling circuit configured to circulate a second coolant in thermal communication with a second group of components, the second group of components comprising an engine and an exhaust elbow, a first coolant pump connected in fluid communication with the first cooling circuit, and a heat exchanger configured to conduct the first and second coolants therethrough in thermal communication with each other.

In a preferred embodiment of the present invention, it further comprises a pressure release device attached to the exhaust elbow and configured to permit the second coolant to flow out of the exhaust elbow when a pressure of the second coolant within the exhaust elbow exceeds a predetermined magnitude. The first group of components can comprise a set of gears in a gear case of the marine propulsion device and an exhaust pipe of the engine. It can further comprise a fuel supply module and a power steering cooler. The second group of components can comprise a cylinder head of the engine and an exhaust manifold. The exhaust manifold and the exhaust elbow can be made of aluminum.

The first coolant can be water drawn from a body of water by the first coolant pump and the second coolant can comprise a mixture of ethylene glycol. The second group of components can comprise a catalyst housing. The system can further comprise a second coolant pump connected in fluid communication with the second cooling circuit and configured to cause the second coolant to circulate through the second cooling circuit.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
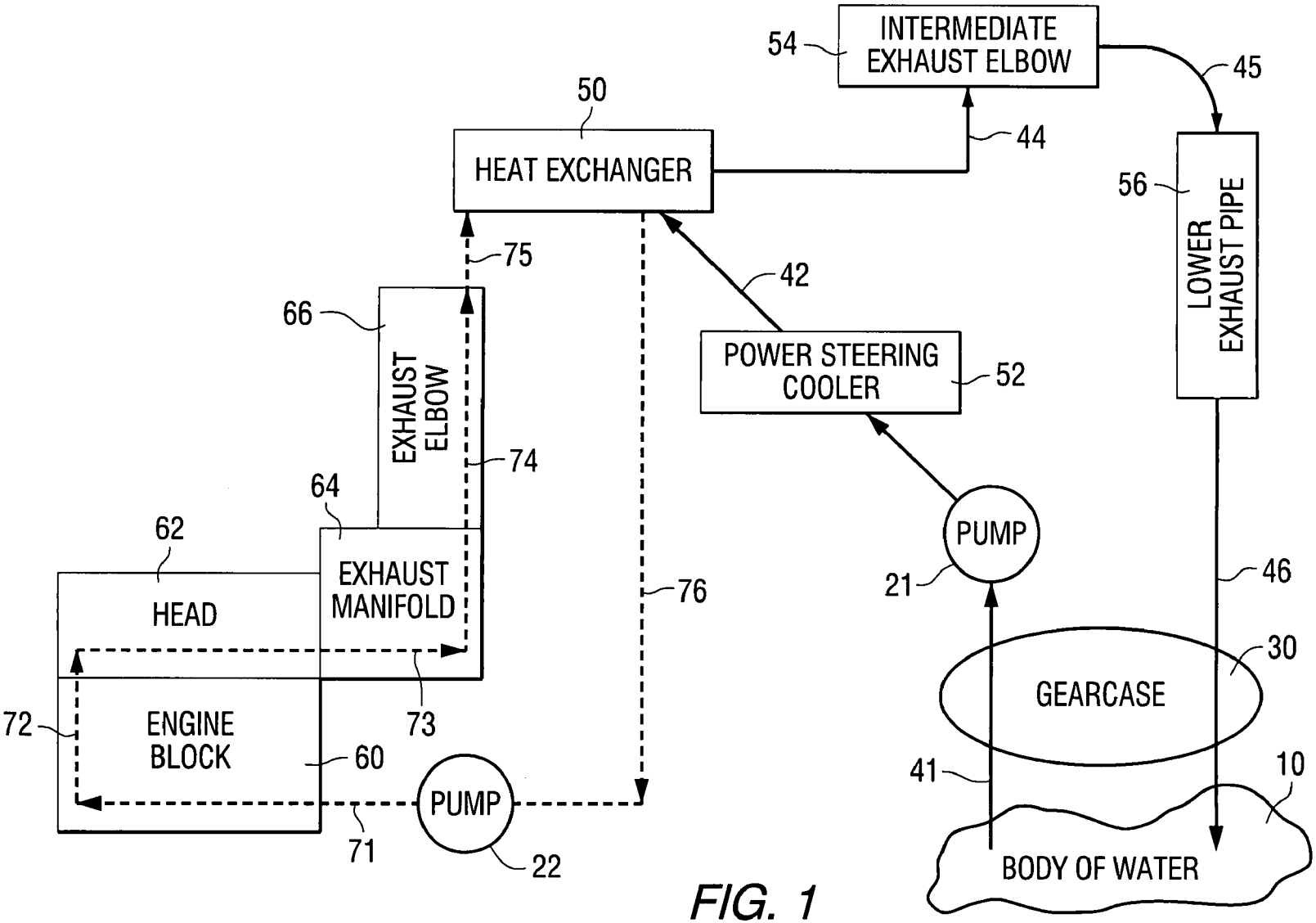
FIG. 1 is a highly schematic representation of the closed cooling system of the present invention, including both an open portion and a closed portion.

Throughout the description of the preferred embodiment of the present invention, like components will be identified by like reference numerals.

FIG. 1 is a highly simplified schematic representation of a cooling system for a marine propulsion device made in accordance with a preferred embodiment of the present invention. The cooling system circulates water, as represented by solid line arrows in FIG. 1, and a coolant, such as an ethylene glycol mixture, represented by dashed line arrows in FIG. 1. The water is drawn from a body of water 10 by a first pump 21 which, in a preferred embodiment of the present invention, is located in a drive component attached to the transom of a marine vessel. Reference numeral 30 represents a gear case of the drive component. The water is drawn upwardly, as represented by arrow 41, and induced, by the first pump 21, to flow in the direction represented by arrow 42 toward a heat exchanger 50. The water flows through the power steering cooler 52 and then to the heat exchanger. After flowing through the heat exchanger, it continues to flow as represented by arrow 44 to an intermediate exhaust elbow 54. After flowing through the intermediate exhaust elbow 54, in thermal communication with exhaust gases passing through the intermediate exhaust elbow, it is conducted to a lower exhaust pipe 56 as represented by arrow 45. After passing through the lower exhaust pipe 56 in thermal communication with exhaust gases, the water is conducted back through the gear case 30 as represented by arrow 46. This water is returned to the body of water 10. In certain embodiments of the present invention, the water flows with a stream of exhaust gases and is directed through a hub of a propeller of the marine propulsion system.

With continued reference to FIG. 1, a closed loop cooling system of the present invention comprises a second pump 22, or circulation pump, which induces a coolant to flow into a coolant jacket of an engine block 60, as represented by dashed line arrow 71. The coolant then flows through the engine block and into the head 62, as represented by dashed line arrow 72, and through the head to the exhaust manifold 64 as represented by dashed line arrow 73. The coolant then continues to flow into the exhaust elbow 66, as represented by dashed line arrow 74, and into the heat exchanger 50 as represented by dashed line arrow 75. After passing through the heat exchanger 50, in thermal communication with the water flowing from the first pump 21, the coolant returns to the inlet of the second pump 22 as represented by dashed line arrow 76. It should be understood that the schematic representation in FIG. 1 has been simplified in order to show the functional and positional relationships between various major components of the marine propulsion system.

Figure 2:
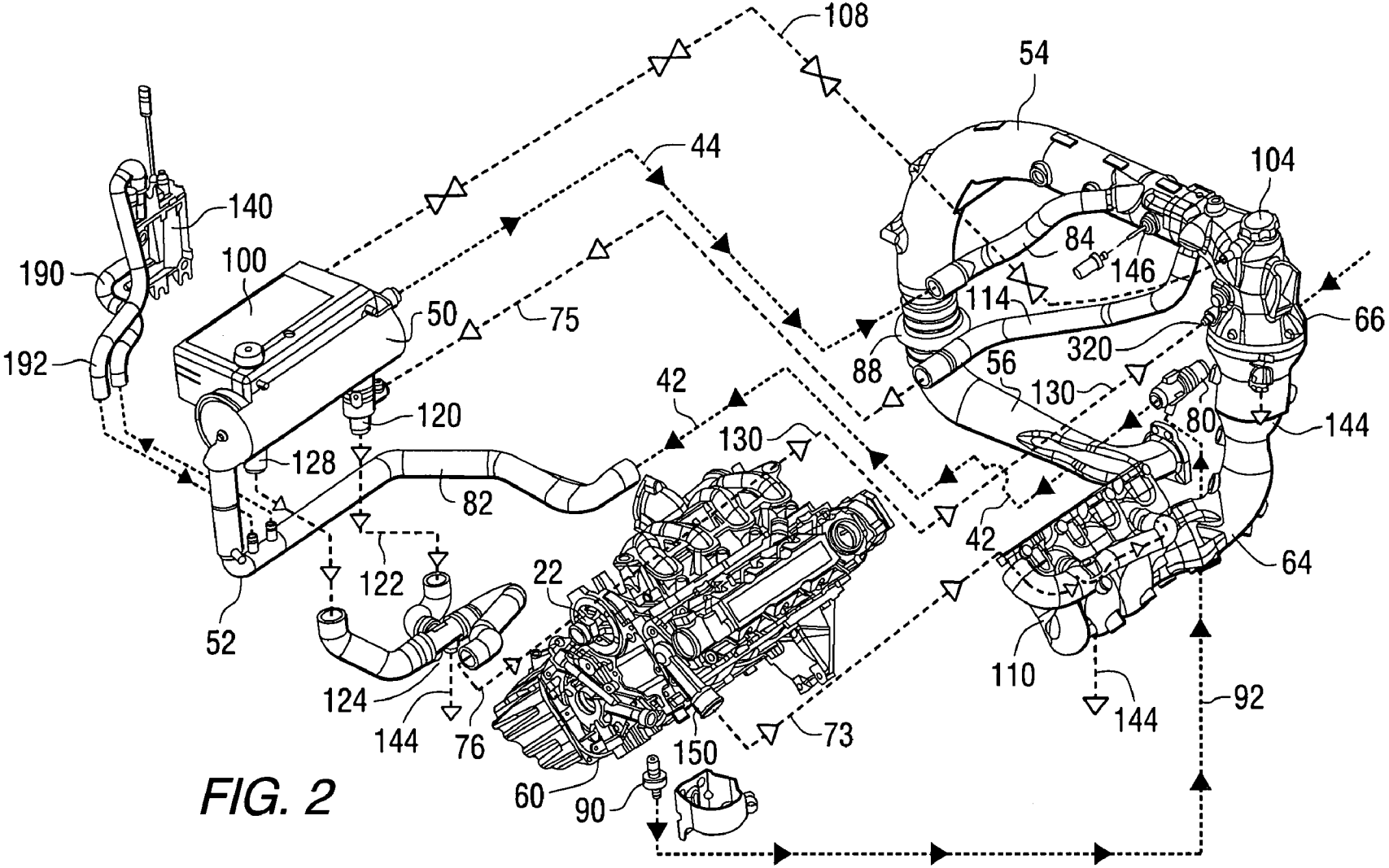
FIG. 2 is an exploded isometric view of selected components of the present invention.

FIG. 2 is an exploded isometric view of a cooling system made in accordance with a preferred embodiment of the present invention. Water is drawn from the body of water, as described above in conjunction with FIG. 1, and passes through a sea water inlet fitting 80 which extends through the transom of a marine vessel. The water flows to the heat exchanger 50 through the conduit identified by reference numeral 82. In FIG. 2, the power steering cooler 52 is shown upstream from the heat exchanger 50, whereas it is shown downstream from the heat exchanger in FIG. 1. It should be understood that the precise relative locations of these components is not limiting to the present invention.

After passing through the heat exchanger, the water is directed, as represented by dashed line arrow 44 and conduit 84, to the intermediate exhaust elbow 54. A rubber exhaust bellows 88 connects the intermediate exhaust elbow 54 to the lower exhaust pipe 56 which directs the water and exhaust gases through the transom and through conduits in the drive unit to be returned to the body of water from which the water is drawn. A sea water flush connection 90, which is normally closed, can allow a flow of water as represented by dashed line arrow 92 into the sea water inlet fitting 80. This connection allows the operator of the marine vessel to flush the entire sea water handling portion of the cooling system.

With continued reference to FIG. 2, a coolant reservoir 100 is connected to a cooling system pressure cap 104 to allow the coolant to flow bidirectionally as represented by dashed line arrow 108. A plurality of exhaust gas conduits 110 directs the flow of exhaust gas to the exhaust manifold 64. From there, the exhaust gas is conducted upward through the exhaust elbow 66. After flowing through the water jacket passages of the exhaust elbow 66, the coolant is directed through conduit 114 and, as represented by dashed line arrow 75, is returned to the heat exchanger 50. Reference numeral 120 identifies a thermostat in the closed coolant loop. Its function is to control the temperature of coolant flowing through the closed coolant loop. Reference numeral 122 illustrates an engine heat exchanger bypass line which conducts a varying amount of coolant, based upon the stroke of the thermostat, around the heat exchanger. This feature facilitates engine warm-up while not sacrificing heat transfer capacity. This bypass is progressively closed as the thermostat strokes open. It is completely blocked when the thermostat is fully stroked. Reference numeral 128 identifies an engine heat exchanger outlet through which coolant is returned to the circulating pump. A cylinder head vent line directs coolant to the elbow 66 as represented by dashed line arrows 130.

With continued reference to FIG. 2, a water cooled fuel supply module 140 can also be connected to conduit 82 as shown. In FIG. 2, coolant drain plugs 144 are provided at three locations and an exhaust manifold coolant temperature sensor 146 is provided to measure the temperature of the sea water in the intermediate exhaust elbow 54. An outlet fitting 150 is provided to direct coolant from the engine head to the cooling passages of the exhaust structure.

Figure 3:
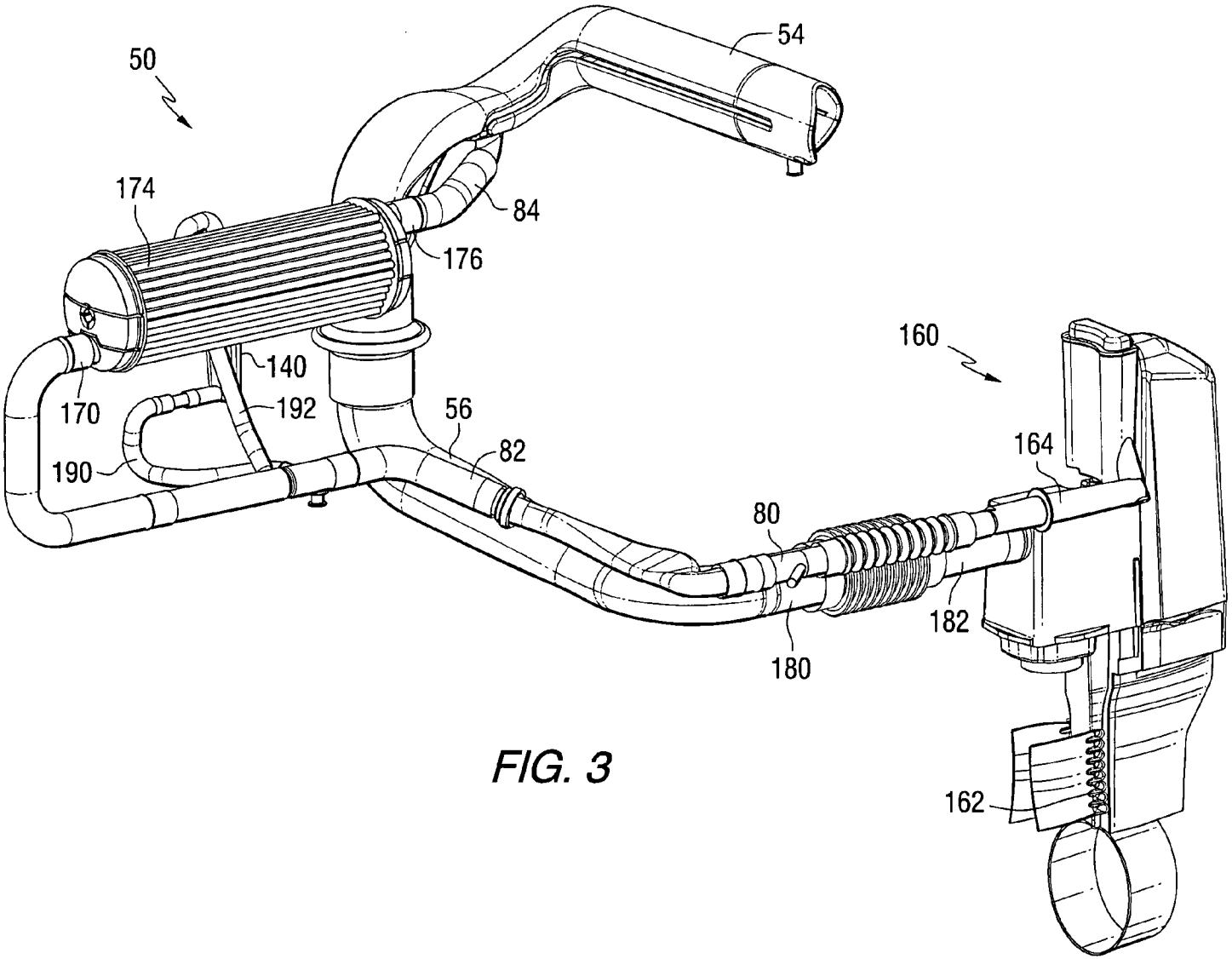
FIG. 3 is an isometric view of a portion of the cooling system of the present invention.

FIG. 3 is an isometric view of some of the components of the present invention which conduct water that is drawn from the body of water 10 by the first pump 21 as described above in conjunction with FIG. 1. Representative portions of the drive unit 160 are shown in FIG. 3. These include water inlet ports 162 and a conduit 164 which directs a flow of water in a forward direction through the sea water inlet fitting 80 which is described above in conjunction with FIG. 2. After passing through the sea water inlet fitting 80 at the transom of a marine vessel, the water is further directed through conduit 82 to the inlet 170 of the heat exchanger 50.

In FIG. 3, the outer shell of the heat exchanger 50 is not shown. As a result, the tubes 174 of the heat exchanger through which the water passes are visible. The water is directed through an outlet 176 of the heat exchanger 50 and through conduit 84 toward the intermediate exhaust elbow 54. The water is then directed downwardly through the lower exhaust pipe 56 and back through the transom of the marine vessel. Conduits 180 and 182 conduct the exhaust gas and water back to the drive unit 160. The exhaust gas and water are then conducted downwardly through the drive unit and emitted through the propeller. Conduits 190 and 192 conduct a portion of the water to the water cooled fuel supply module 140, and then return it to conduit 82. The first pump 21 which is described above in conjunction with FIG. 1 is contained within the structure of the drive unit 160 and is connected in fluid communication between the inlet ports 162 and conduit 164.

Figure 4:
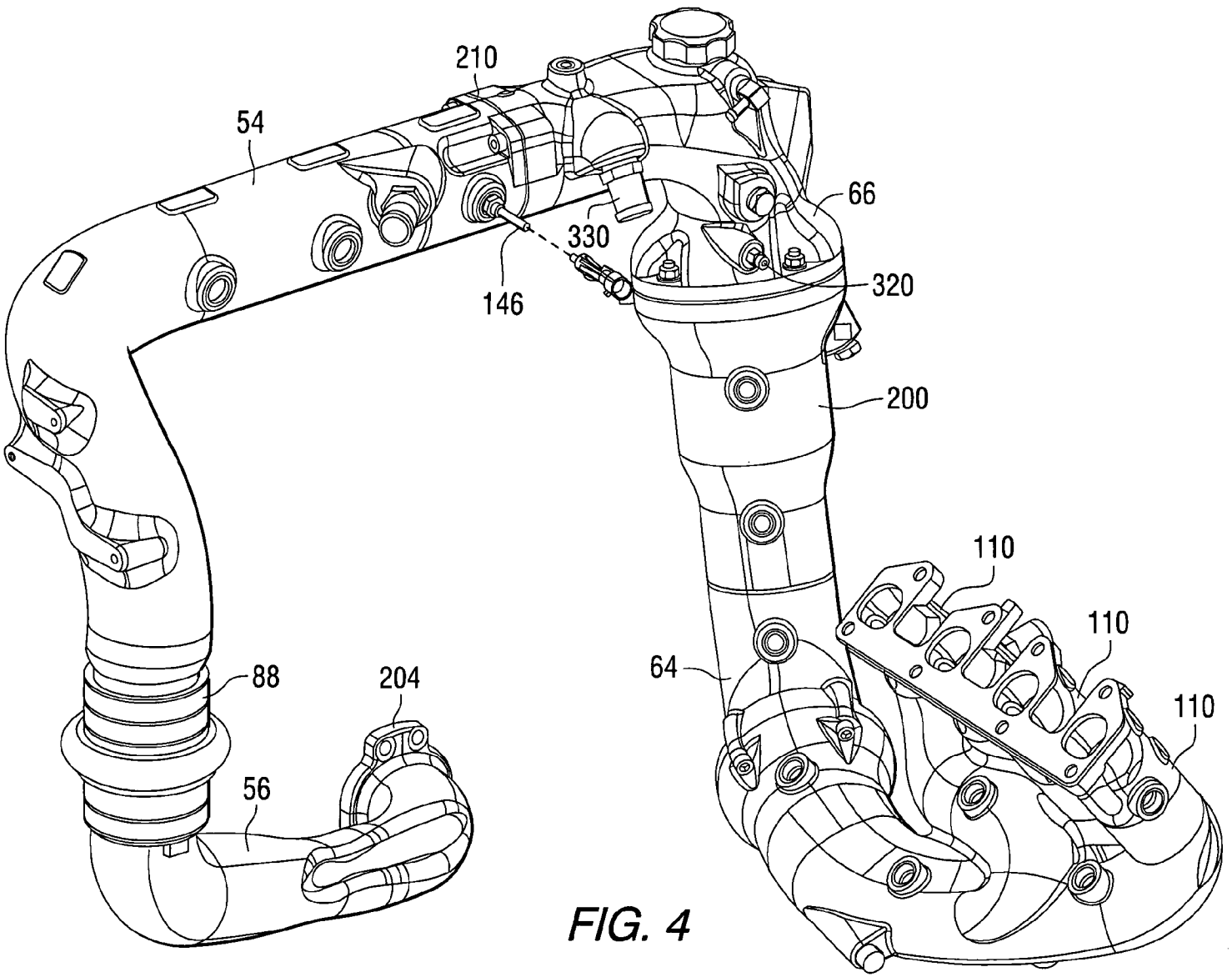
FIG. 4 is an isometric view of a portion of the present invention.

FIG. 4 shows the closed loop portion of the cooling system of the present invention. Four exhaust conduits 110 direct exhaust gas to an exhaust manifold 64 which, in turn, directs the exhaust gas through the exhaust elbow 66. As will be described in greater detail below, a portion of the exhaust manifold 64 is a catalyst housing 200. The exhaust elbow 66 is attached to the intermediate exhaust elbow 54 which, in turn, is connected to the lower exhaust pipe 56. A rubber exhaust bellows 88 is connected between the intermediate exhaust elbow 54 and the lower exhaust pipe 56. The flange 204 allows the lower exhaust pipe 56 to be attached to an inside surface of the transom of a marine vessel.

With continued reference to FIG. 4, the joint identified by reference numeral 210 defines the boundary, or interface, between a first cooling circuit which circulates water in thermal communication with a first group of components and a second cooling circuit which circulates an ethylene glycol mixture through a second group of components. The second cooling circuit is a closed loop cooling system that removes heat from the engine block 60, the head 62, the exhaust manifold 64, and the exhaust elbow 66. The first cooling circuit circulates water, drawn from a body of water 10, through the intermediate exhaust elbow 54 and the lower exhaust pipe 56. In certain embodiments of the present invention, the first cooling circuit also circulates water through a power steering cooler 52. Both the first and second cooling circuits circulate their first and second coolants, respectively, through the heat exchanger 50 in order to remove heat from the second coolant and absorb heat into the first coolant. Significant heat transfer occurs at boundary 210, in addition to the heat transfer within the heat exchanger 50. The heat transfer at boundary 210 allows the use of a smaller heat exchanger.

Figure 5:
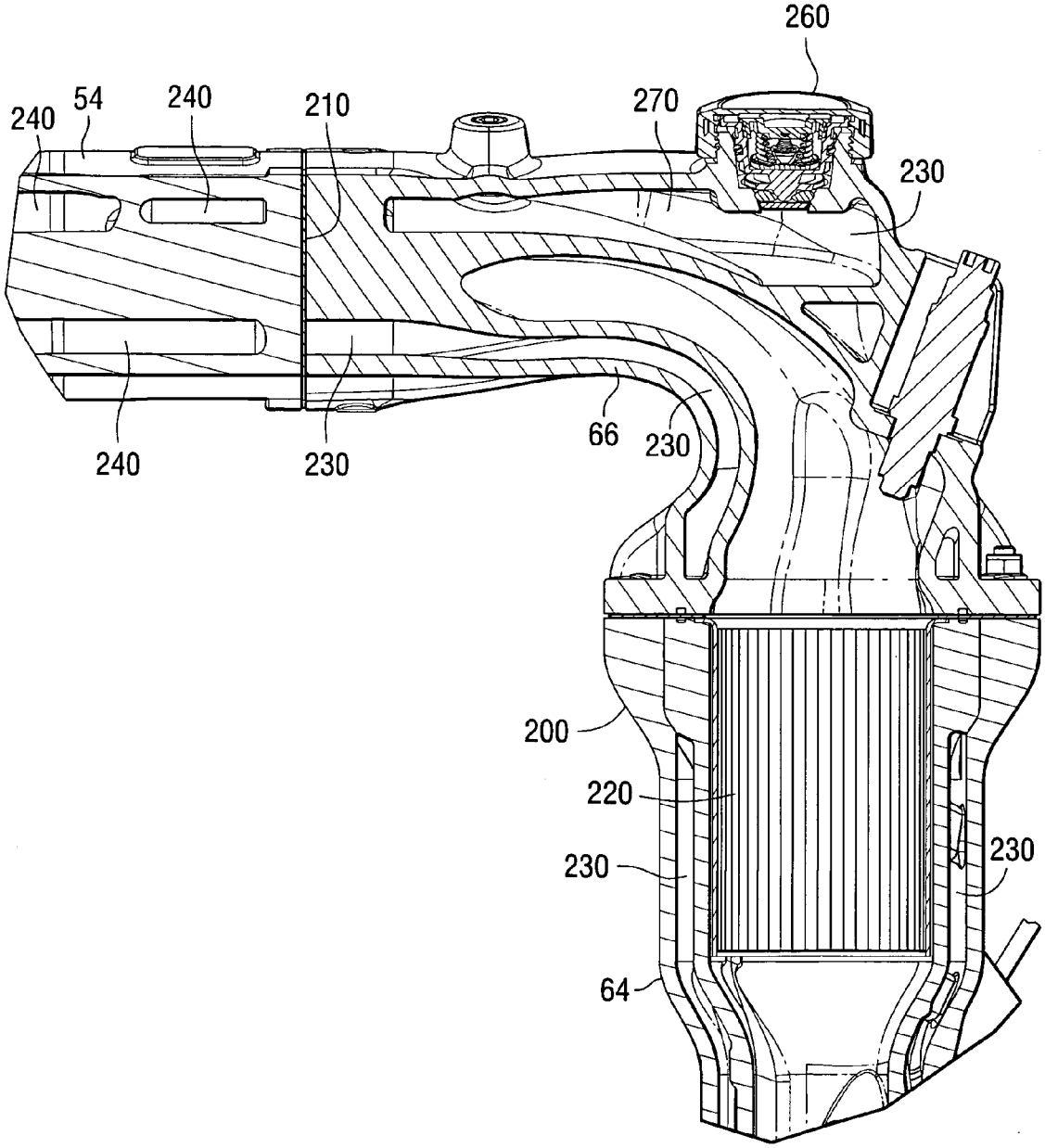
FIG. 5 is a section view of a portion of the exhaust manifold, exhaust elbow, and intermediate exhaust elbow of the present invention.

FIG. 5 is a section view of a portion of the system illustrated in FIGS. 2 and 4. More particularly, FIG. 5 shows a section view of the exhaust manifold 64 and the exhaust elbow 66. Attached to the exhaust elbow 66 is the intermediate exhaust elbow 54. As discussed above in conjunction with FIG. 4, the seam, or interface, identified by reference numeral 210 separates the first and second cooling circuits. The upper portion of the exhaust manifold 64 is the catalyst housing 200 in which a catalyst element 220 is disposed.

With continued reference to FIGS. 2, 4 and 5, exhaust gas flowing from the exhaust conduit 110 and through the exhaust manifold 64 continues to flow upward through the catalyst housing 200 and into the exhaust elbow 66. The components to the right of the interface 210 are cooled by the second coolant flowing through the second cooling circuit which, as described above, is the closed cooling circuit. The second coolant is a mixture, in a preferred embodiment of the present invention, of ethylene glycol and distilled water. The coolant passages identified by reference numeral 230 conduct the second coolant in thermal communication with the heat emitting components to the right of interface 210 and upstream of the exhaust elbow 66. On the other hand, the intermediate exhaust elbow 54 is cooled by water flowing through the first cooling circuit. Water flows through the passages identified by reference numeral 240 in FIG. 5. It should be understood that the section view shown in FIG. 5 is taken to illustrate the position of the catalyst and some of the passages used to conduct the first and second coolants. The section view does not show the complete continuous exhaust gas passage which extends through the interface 210 between the exhaust elbow 66 and the intermediate exhaust elbow 54.

With reference to FIGS. 1-5, it can be seen that the present invention provides significant advantages relative to known cooling systems for marine propulsion devices. It provides a closed cooling system with the second coolant (e.g. ethylene glycol mixture) being directed to flow in thermal communication with the water jacket 230 of the exhaust elbow 66. This, in combination with the provision of the coolant jacket 230 around the catalyst 220 that is contained within the catalyst housing 200, maintains the temperature of the catalyst 220 and its associated oxygen sensors at a magnitude that is equivalent to the engine temperature coolant. This is intentionally done to avoid potential condensation from occurring within these regions as could possibly happen if colder water, from the body of water 10, is used to remove heat from the exhaust manifold 64 and exhaust elbow 66.

With continued reference to FIGS. 1-5, it should be realized that the exhaust elbow 66 is the highest point of the cooling circuit. For this reason, a pressure cap 260 is located on the exhaust elbow 66. A low velocity accumulator section 270 has been provided in relation to the elbow 66. The pressure cap 260 is located at the top of the accumulator portion 270 of the elbow 66. Any compressible gas within the cooling passages flows to the high point of the system, exhaust elbow 66, and is then intentionally accumulated in 270. The gas migrates to the 270 accumulator as this is a low velocity, calming area. When the relief pressure magnitude provided by the cap 260 is reached, due to the thermal expansion of the coolant, the air or coolant within the accumulator section 270 is vented to an atmospherically vented reservoir 100. This flow is represented by dashed line 108 in FIG. 2. Conversely, liquid coolant is returned to the engine circuit upon cool down of the coolant within the engine circuit water passages.

With continued reference to FIGS. 1-5, heat transfer occurs at the gasketed interface 210 between the exhaust elbow 66 of the second cooling circuit and the intermediate elbow 54 of the first cooling circuit. Although results will vary as a function of the specific application of the present invention, one embodiment has been monitored experimentally and more than 10 kilowatts of heat energy has been measured being transferred through the interface 210. This characteristic is favorable because it results in a potential reduction in the overall size and capacity of the heat exchanger 50.

The use of a closed cooling circuit, including the exhaust manifold 64 and exhaust elbow 66, allows aluminum to be used to manufacture the exhaust manifold 64, the catalyst housing 200, and the exhaust elbow 66. Cooling systems used in sea water applications would otherwise require the use of a cast iron alloy for these components in order to provide adequate product life. The ability to use aluminum instead of cast iron for these components resulted, in one embodiment of the present invention, in a weight reduction of approximately 35 pounds. This weight reduction can result in measurable improvements in both boat acceleration and top speed. Certain embodiments of the present invention, which comprise a long tuned exhaust system, exhibit a greater magnitude of heat being transferred from the exhaust to the coolant than from the engine to the coolant. This, of course, affects the overall required size of the heat exchanger 50.

Figure 6:
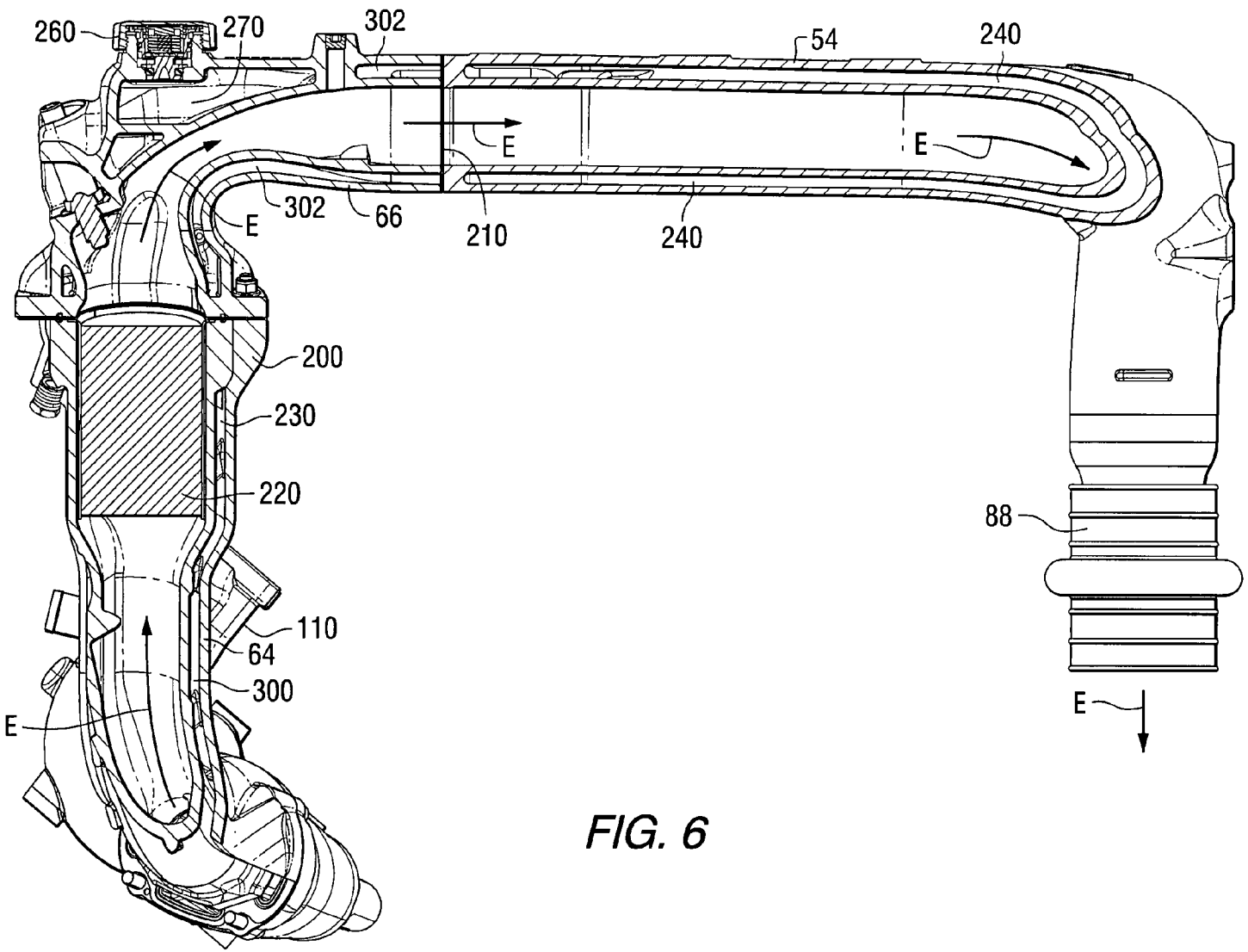
FIG. 6 is a section isometric view of various exhaust conduits of the present invention.

FIG. 6 is an isometric section view of the structure illustrated in FIG. 4 without the lower exhaust pipe 56 and the flange 204 which attaches to the exhaust system of the drive unit. As described above, in conjunction with FIG. 4, exhaust gas flows into the exhaust conduits 110 and through the exhaust manifold 64. The flow of exhaust gas is represented by arrow E in FIG. 6. Surrounding the exhaust gas conducting conduit of the exhaust manifold 64 is a coolant jacket 300 which conducts a flow of the second coolant which is recirculated through the second cooling circuit described above. The cooling jacket 300 surrounding the exhaust manifold 64 is connected in fluid communication with the cooling jacket 302 surrounding the exhaust elbow 66. The catalyst element 220 is contained within the catalyst housing 200. The coolant jacket identified by reference numeral 230 and described above in conjunction with FIG. 5, is an upper extension portion of the coolant jacket 300 which surrounds the exhaust manifold 64. It should be clearly understood that the coolant jacket identified by reference numerals 230, 270, 300 and 302 are connected in fluid communication with each other and cooperate with each other to circulate the second coolant which, in a particularly preferred embodiment of the present invention, is a mixture of ethylene glycol and distilled water.

With continued reference to FIGS. 5 and 6, the exhaust gas E flows from the exhaust elbow 66 to the exhaust passage of the intermediate exhaust elbow 54. The interface 210, which is provided by a gasket that blocks the flow of coolant within cooling jacket 302 but does not block the flow of exhaust gas E, is located between the end faces of the exhaust elbow 66 and the intermediate exhaust elbow 54. Water is circulated through the coolant passage 240 of the intermediate exhaust elbow. This water within coolant jacket 240 is the first coolant of the first cooling circuit and the coolant flowing within the coolant jacket 230, 270, 300 and 302 (to the left of interface 210 in FIG. 6) is the second coolant of the second cooling circuit. In a preferred embodiment of the present invention, the exhaust manifold 64 and the exhaust elbow 66 can be made of aluminum while the intermediate exhaust elbow 54 would typically be made of cast iron. The provision of the second cooling circuit, comprising cooling jackets 230, 300 and 302, allow this use of aluminum which provides a significant weight reduction in comparison to the use of cast iron for these components. As described above in conjunction with FIG. 5, a portion of the coolant passage 302 of the exhaust elbow 66, which is identified by reference numeral 270, is intentionally designed to provide a low velocity region through which the second coolant experiences a reduction in its velocity and where gases can collect. The pressure releasing function of the cap 260 can therefore work efficiently to release gases from the second coolant and direct those gases and/or the expanding coolant to the coolant reservoir 100 when the pressure within the coolant jacket of the exhaust elbow 66 exceeds a predetermined magnitude. Solid liquid coolant is drawn back into the engine water jackets upon coolant cool down.

Figure 7:
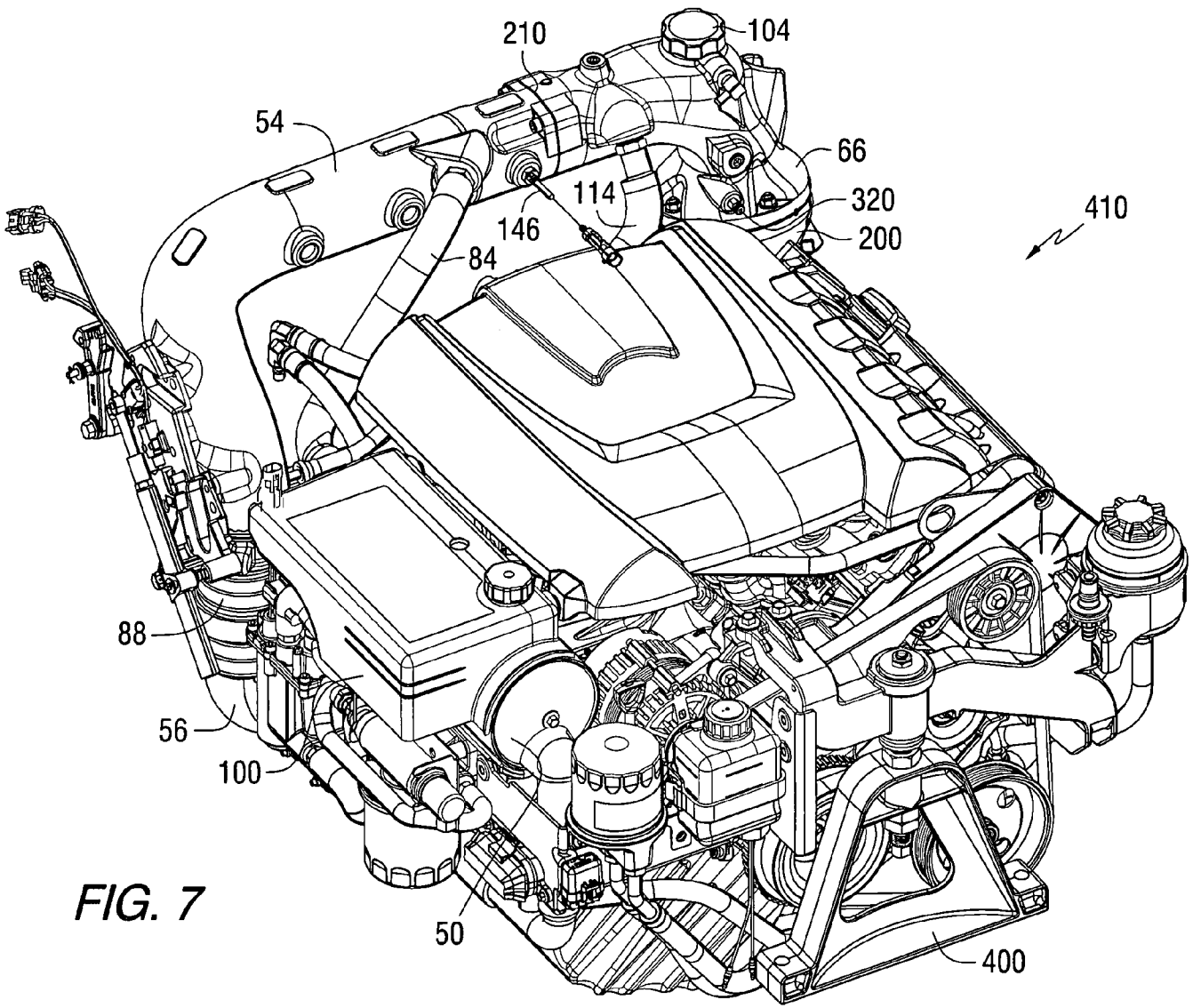
FIG. 7 is an isometric view of an engine comprising the cooling system of the present invention.

FIG. 7 is an isometric view of a marine engine which comprises the cooling system of the present invention. A support bracket 400 is shown attached to the front portion of the engine 410. Throughout the description of FIG. 7, only those components relating to the cooling system will be described.

With continued reference to FIG. 7, the heat exchanger 50 is shown adjacent the coolant reservoir 100. The catalyst housing 200, which is the upper portion of the exhaust manifold 64 (not visible in FIG. 7) is shown connected to the exhaust elbow 66. The pressure releasing cap 104 is located at the uppermost portion of the second cooling circuit as described above. The conduit identified by reference numeral 114 directs the second coolant back to the heat exchanger 50 and the conduit identified by reference numeral 84 directs a flow of water, drawn from a body of water, from the heat exchanger 50 toward the coolant jackets of the intermediate elbow 54. The interface 210 between the exhaust elbow 66 and the intermediate exhaust elbow 54 is shown in FIG. 7. A coolant sensor 146 is shown connected to the intermediate exhaust elbow 54 as described above in conjunction with FIG. 2. The exhaust conduits illustrated in FIG. 7 direct the flow of exhaust gases from the exhaust ports on the port side of the engine 410, through the exhaust manifold 64 (not shown in FIG. 7), upwardly through the catalyst housing 200 and the exhaust elbow 66, through the intermediate exhaust elbow 54 and downwardly through the rubber exhaust bellows 88 and lower exhaust pipe 56 to an opening through the transom of the marine vessel where the flange 204, which is identified in FIG. 4, is attached.

With reference to FIGS. 1-7, it can be seen that a cooling system for a marine propulsion device made in accordance with a preferred embodiment of the present invention comprises a first cooling circuit that is configured to circulate a first coolant, such as water drawn from a body of water, in thermal communication with a first group of components, a second cooling circuit configured to circulate a second coolant, such as a mixture of ethylene glycol and distilled water, in thermal communication with a second group of components, a first coolant pump 21 connected in fluid communication with the first cooling circuit, and a heat exchanger 50 configured to conduct the first and second coolants therethrough in thermal communication with each other. The second group of components comprise the engine 410 and the exhaust elbow 66. As described above, the engine 410 comprises the engine block 60 and the cylinder head 62. In addition, the exhaust manifold 64 is connected between the cylinder head 62 and the exhaust elbow 66. A pressure release device 104 is attached to the exhaust elbow 66 and configured to permit the second coolant to flow out of the exhaust elbow 66 when a pressure of the second coolant within the exhaust elbow exceeds a predetermined magnitude. This coolant flowing through the pressure release device 104 flows, as represented by dashed line arrows 108, to the coolant reservoir 100. The first group of components comprises a set of gears in the gear case 30 of the marine propulsion device and an exhaust pipe, such as intermediate exhaust elbow 54 and lower exhaust pipe 56, of the engine 410. The first group of components can comprise a fuel supply module and a power steering cooler 52. The second group of components can comprise the cylinder head 62 of the engine 410 and an exhaust manifold 64. As described above, the exhaust manifold 64 and the exhaust elbow 66 are made of aluminum in a particularly preferred embodiment of the present invention. The first coolant can be water drawn from a body of water by the first coolant pump 21 and the second coolant can comprise an ethylene glycol mixture.

The second group of components can comprise a catalyst housing 200. A second coolant pump 22 can be connected in fluid communication with the second cooling circuit and configured to cause the second coolant to circulate the second cooling circuit.

With continued reference to FIGS. 1-7, in a preferred embodiment of the present invention the engine 410 is a four cylinder engine which is tilted at a 50 degree angle from vertical. This can be most clearly seen in FIGS. 2 and 7. In order to properly vent air from the coolant jackets of the second cooling system, a vent line is connected to the port identified by reference number 320. The closed portion of the cooling system of the present invention includes the exhaust manifold 64 and the exhaust elbow 66. This arrangement of the closed cooling portion of the system, which is significantly different from cooling systems known for use in marine engines, provides the second coolant around the catalyst housing 200 and the associated oxygen sensors of the engine. This allows the water jacket surrounding the catalyst and sensors to be maintained at the engine coolant temperature in order to avoid condensation from occurring within the exhaust gas passage with possible damage resulting to the catalyst or oxygen sensors.

Condensation is known to occur within exhaust passages when the water jacket fluid temperature is less than or equal to 120 degrees Fahrenheit. Since the exhaust elbow 66 is the high point of the cooling circuit, the pressure cap 104 is located at the exhaust elbow. This is different than is known in the prior art. In order to allow this location of the pressure cap 104, the low velocity region identified by reference numeral 270 is provided. The internal configuration of the coolant jacket 302 of the exhaust elbow 66 causes the coolant to initially flow toward the interface 210 at the end of the exhaust elbow 66 and then turn back toward the outlet 330 to flow through conduit 114 back to the heat exchanger 50. This reversal creates a low velocity flow within the region identified by reference numeral 270. The pressure cap 104 is located at the top of this accumulator portion 270 of the elbow. When the preselected cap relief pressure is reached due to the thermal expansion of the coolant, air or coolant located within the region identified by reference numeral 270 is vented to an atmospherically vented reservoir 110. Solid liquid coolant is drawn back into the engine water jackets upon coolant cool down.

With continued reference to FIGS. 1-7 and particularly to FIGS. 5 and 6, it should be noted that heat transfer occurs at the interface identified by reference numeral 210. This interface 210, between the exhaust elbow 66 and the intermediate elbow 54, has been determined to be greater than 10 kilowatts. This is a favorable result because heat flows from the exhaust elbow 66 toward the intermediate exhaust elbow 54 and reduces the need for heat reduction by the heat exchanger 50. This, in turn, reduces the necessary size of the heat exchanger. Because a closed cooling system is utilized, the exhaust manifold 64, the catalyst housing 200, and the exhaust elbow 66 can be made of aluminum. In sea water applications, cast iron alloys would otherwise have to be used for these components if they were not part of the closed cooling system using ethylene glycol and distilled water mixtures. The use of aluminum, as compared to cast iron, for these components reduces the overall weight of the marine propulsion device by approximately 35 pounds. This has a significant benefit on boat acceleration and top speed capabilities.

Although the present invention has been described with particular specificity and illustrated to show a preferred embodiment, it should be understood that alternative embodiments are also within its scope.

We claim:

1. A cooling system for a marine propulsion device, comprising:

a first cooling circuit configured to circulate a first coolant in thermal communication with a first group of components;

a second cooling circuit configured to circulate a second coolant in thermal communication with a second group of components, said second group of components comprising an engine and an exhaust elbow;

a first coolant pump connected in fluid communication with said first cooling circuit;

a heat exchanger configured to conduct said first and second coolants therethrough in thermal communication with each other;

a pressure release device attached to said exhaust elbow and configured to permit said second coolant to flow out of said exhaust elbow when a pressure of said second coolant within said exhaust elbow exceeds a predetermined magnitude.

2. The cooling system of claim 1 wherein:

said first cooling circuit is an open loop cooling circuit;

said second cooling circuit is a closed loop cooling circuit;

said exhaust elbow includes a low velocity accumulator section at said pressure release device such that compressible gas in said second cooling circuit migrates to and accumulates in said low velocity accumulator section.

3. The cooling system of claim 2 wherein said second coolant and compressible gas in said low velocity accumulator section, upon reaching said predetermined pressure magnitude, is vented through said pressure release device to a reservoir which is atmospherically vented.

* * * * *